US011508302B2

(12) United States Patent
Chang et al.

(10) Patent No.: US 11,508,302 B2
(45) Date of Patent: Nov. 22, 2022

(54) METHOD FOR DRIVING DISPLAY PANEL AND RELATED DRIVER CIRCUIT

(71) Applicant: NOVATEK Microelectronics Corp., Hsin-Chu (TW)

(72) Inventors: Chieh-Hsiang Chang, Miaoli County (TW); Wen-Pin Tsai, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 17/519,592

(22) Filed: Nov. 5, 2021

(65) Prior Publication Data

US 2022/0148505 A1 May 12, 2022

Related U.S. Application Data

(60) Provisional application No. 63/110,380, filed on Nov. 6, 2020.

(51) Int. Cl.
*G09G 3/3233* (2016.01)

(52) U.S. Cl.
CPC ... *G09G 3/3233* (2013.01); *G09G 2300/0842* (2013.01); *G09G 2310/0248* (2013.01); *G09G 2310/0297* (2013.01); *G09G 2310/08* (2013.01); *G09G 2320/0233* (2013.01); *G09G 2330/021* (2013.01)

(58) Field of Classification Search
None
See application file for complete search history.

(56) References Cited

U.S. PATENT DOCUMENTS

2011/0304594 A1* 12/2011 Huang ..... G09G 3/20 345/204
2017/0004798 A1* 1/2017 Park ..... G09G 3/3677
2020/0111418 A1* 4/2020 Nam ..... G09G 3/3266
2021/0350735 A1* 11/2021 Kim ..... G09G 3/3611

FOREIGN PATENT DOCUMENTS

CN 112365843 A * 2/2021 ..... G09G 3/3208
EP 3113012 A2 * 1/2017 ..... G09G 3/3406
TW 201939479 A 10/2019
TW 202016705 A 5/2020

* cited by examiner

*Primary Examiner* — Dorothy Harris
(74) *Attorney, Agent, or Firm* — Winston Hsu

(57) ABSTRACT

A method for a driver circuit configured to drive a display panel includes steps of: outputting a plurality of control signals according to a first control timing scheme to control a multiplexing circuit comprising a plurality of switches disposed in the display panel in a first operation mode; and outputting the plurality of control signals according to a second control timing scheme to control the multiplexing circuit in a second operation mode. Wherein, the first control timing scheme comprises a pre-charge period in which the plurality of switches of the multiplexing circuit are turned on, and the second control timing scheme comprises no pre-charge period.

36 Claims, 10 Drawing Sheets

METHOD FOR DRIVING DISPLAY PANEL AND RELATED DRIVER CIRCUIT

CROSS REFERENCE TO RELATED APPLICATIONS

This application claims the benefit of U.S. Provisional Application No. 63/110,380, filed on Nov. 6, 2020, the contents of which are incorporated herein by reference.

BACKGROUND OF THE INVENTION

1. Field of the Invention

The present invention relates to a driving method and driver circuit for a display panel, and more particularly, to a driving method and driver circuit for a light-emitting diode (LED) panel.

2. Description of the Prior Art

The general light emitting principle of an organic light-emitting diode (OLED) display panel is to apply a data voltage to a driving transistor (e.g., thin-film transistor (TFT)) in a pixel of the display panel to control a current flowing through the transistor, to drive the LEDs on the display panel to emit light. However, the threshold voltage of the driving transistor in each pixel is usually inconsistent. In order to compensate for the inconsistency of the threshold voltage, another transistor is deployed with the driving transistor to form a diode-connected structure, and the control timing for the switches is appropriately allocated, in order to eliminate the influences on the display performance resulting from the difference of the threshold voltages.

On the other hand, data output terminals of a display driver and data lines of a display panel that the display driver drives has one-to-multiple relationship. That is, one data output terminal of the data driver may output data voltages to multiple data lines on the display panel in a time divisional manner. Therefore, a multiplexer (MUX) may be disposed on the display panel to switch the output terminal of the display driver between different data lines.

Conventionally, the MUX may be controlled to sequentially transmit data voltages to the data lines, and the corresponding electric charges are stored in the parasitic capacitors on the data lines. The gate control switches (i.e., scan switches) are then turned on to allow the data voltages on the data lines to be input to the pixels (through charge sharing). Each pixel includes a storage capacitor, a light emission element such as an LED, and a pixel circuit composed of multiple TFTs. The driving timing includes an initial phase, a compensation and data writing phase, and a light emission phase. Due to different designs of pixel driving circuits, the compensation, data writing and light emission may also be performed in the same phase. However, the values of parasitic capacitors on each data line may be different, resulting in inconsistent charge sharing capabilities of each data line when the data voltages are written into the pixels. As a result, the charge amount transferred to the pixels will be different, resulting in a decrease in the visual effects of the display panel.

In order to improve the visual effects, in another example, the gate control switch and the MUX may be both turned on during the data output period to directly forward the data voltages to the pixels. However, in this driving method, when the gate control switch is turned on but a switch of the MUX is not yet turned on, the residual charges corresponding to the previous data voltage on the data line may first be input to the pixel (also through charge sharing). Several of the TFTs forming the pixel circuit are connected as the diode-connected structure, which is equivalent to a diode. Based on the operation principle of the diode, the diode may be turned on to pass currents only when the anode voltage is greater than the cathode voltage with a level exceeding the threshold voltage. However, the input charges of the previous data voltage may cause the anode of the diode to reach a lower voltage level or cause the cathode of the diode to reach a higher voltage level, such that a newly received data voltage may not be able to successfully turn on the diode-connected structure to be input to the pixel. In such a situation, this driving method needs to be implemented with a pre-charge operation to clear the charges on the data lines by simultaneously turning on switches of the MUX before the gate control switch is turned on; that is, to pre-charge the voltage of the data line to an appropriate level. This method may achieve better visual effects of the display panel, but the operations of clearing the charges through pre-charge operation and then recharging will cause a significant increase in power consumption.

The former aforementioned control timing scheme usually has worse visual effects to the display panel, and the latter aforementioned control timing scheme usually suffers from higher power consumption since the pre-charge operation is performed. However, in the prior art, only a selected control timing scheme is implemented in the display panel. Thus, there is a need to provide a novel driving method capable of keeping the advantages and improving the disadvantages of the above control timing schemes.

SUMMARY OF THE INVENTION

It is therefore an objective of the present invention to provide a driving method and driver circuit for a display panel, to solve the abovementioned problems.

An embodiment of the present invention discloses a method for a driver circuit. The driver circuit is configured to drive a display panel. The method comprises steps of: outputting a plurality of control signals according to a first control timing scheme to control a multiplexing circuit comprising a plurality of switches disposed in the display panel in a first operation mode; and outputting the plurality of control signals according to a second control timing scheme to control the multiplexing circuit in a second operation mode. Wherein, the first control timing scheme comprises a pre-charge period in which the plurality of switches of the multiplexing circuit are turned on, and the second control timing scheme comprises no pre-charge period.

Another embodiment of the present invention discloses a method for a driver circuit. The driver circuit is configured to drive a display panel. The method comprises steps of: selectively configuring one of a first control timing scheme and a second control timing scheme to a first operation mode; selectively configuring one of the first control timing scheme and the second control timing scheme to a second operation mode; outputting a plurality of control signals according to a first selected control timing scheme to control a multiplexing circuit comprising a plurality of switches disposed in the display panel in the first operation mode; and outputting the plurality of control signals according to a second selected control timing scheme to control the multiplexing circuit in the second operation mode. Wherein, the first control timing scheme comprises a pre-charge period in which the plurality of switches of the multiplexing circuit are turned on, and the second control timing scheme comprises no pre-charge period.

Another embodiment of the present invention discloses a driver circuit configured to drive a display panel. The driver circuit is configured to output a plurality of control signals according to a first control timing scheme to control a multiplexing circuit comprising a plurality of switches disposed in the display panel in a first operation mode, and output the plurality of control signals according to a second control timing scheme to control the multiplexing circuit in a second operation mode. Wherein, the first control timing scheme comprises a pre-charge period in which the plurality of switches of the multiplexing circuit are turned on, and the second control timing scheme comprises no pre-charge period.

Another embodiment of the present invention discloses a driver circuit configured to drive a display panel. The driver circuit is configured to selectively configure one of a first control timing scheme and a second control timing scheme to a first operation mode, selectively configure one of the first control timing scheme and the second control timing scheme to a second operation mode, output a plurality of control signals according to a first selected control timing scheme to control a multiplexing circuit comprising a plurality of switches disposed in the display panel in the first operation mode, and output the plurality of control signals according to a second selected control timing scheme to control the multiplexing circuit in the second operation mode. Wherein, the first control timing scheme comprises a pre-charge period in which the plurality of switches of the multiplexing circuit are turned on, and the second control timing scheme comprises no pre-charge period.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
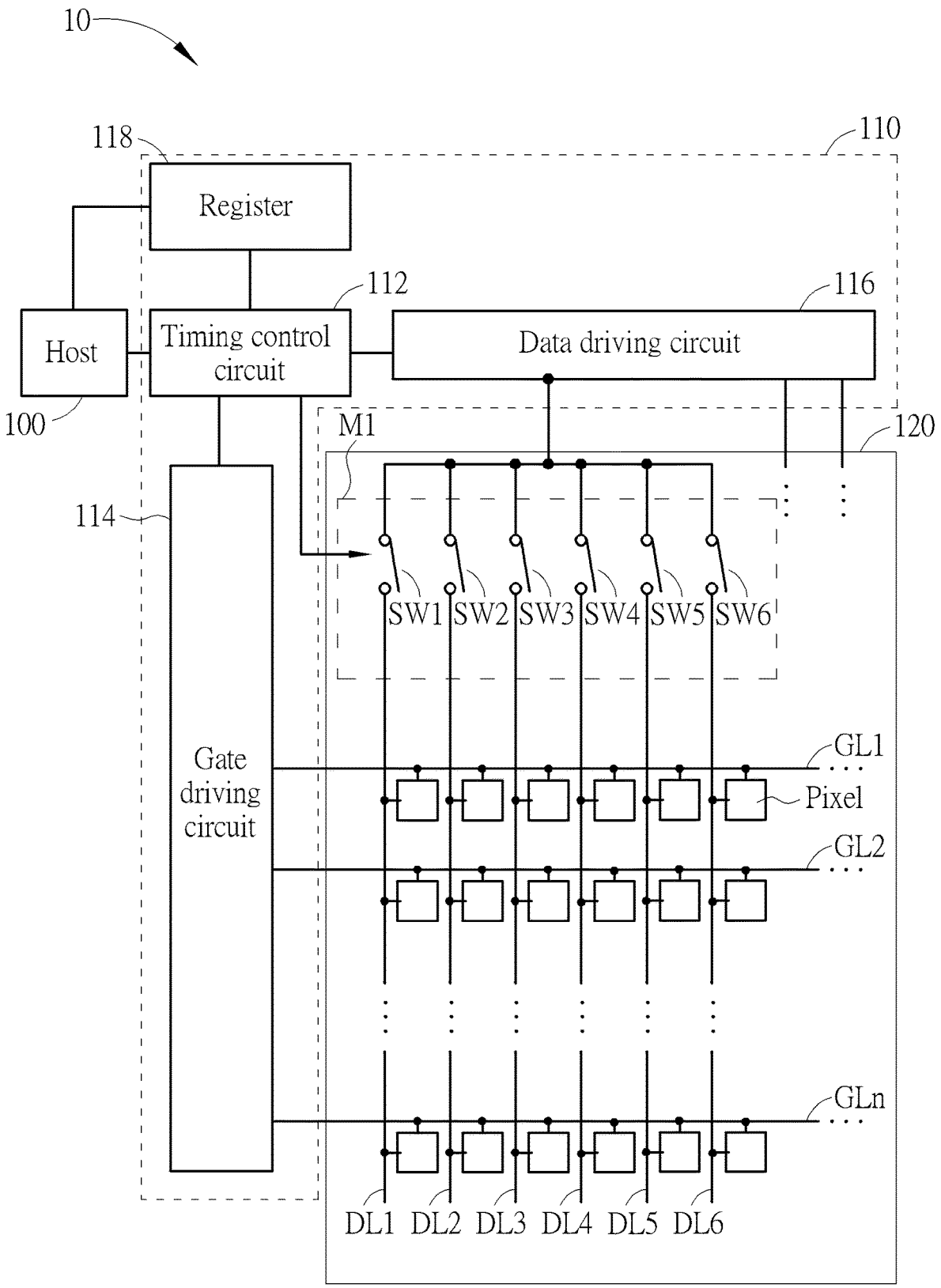
FIG. 1 is a schematic diagram of a display system according to an embodiment of the present invention.

Please refer to FIG. 1, which is a schematic diagram of a display system 10 according to an embodiment of the present invention. As shown in FIG. 1, the display system 10 includes a host device 100, a driver circuit 110 and a display panel 120. The display system 10 may be implemented in an electronic device having display functions such as a laptop, mobile phone, or wearable electronic device. The host device 100 may provide information of the operation mode of the electronic device for the driver circuit 110. When receiving the operation mode information, the driver circuit 110 may determine the control timing scheme for the display panel 120 based on the operation mode of the electronic device. The driver circuit 110 then outputs various control signals to the display panel 120 according to the control timing scheme.

In the embodiments of the present invention, the host device 100 may be, but not limited to, an application processor (AP), a central processing unit (CPU), a microprocessor, or a micro control unit (MCU). The driver circuit 110 may be the circuitry implemented in a display driver integrated circuit (DDIC), an application specific integrated circuit (ASIC), a field programmable gate array (FPGA), or other programmable logic devices. Alternatively, the driver circuit 110 may include multiple chips implemented on a circuit board and cooperating to control the display panel 120. The display panel 120 may be, but not limited to, an organic light-emitting diode (organic-LED, OLED) display panel (which may be any size, such as mini-OLED display panel or micro-OLED display panel). In other case, the display panel 120 may be a mini-LED display panel or a micro-LED display panel.

In detail, the driver circuit 110 includes a timing control circuit 112, a gate driving circuit 114, a data driving circuit 116 and a register 118. The timing control circuit 112 is configured to control the operations of the gate driving circuit 114 and the data driving circuit 116. The gate driving circuit 114 is configured to output gate control signals to the gate lines (e.g., GL1-GLn) on the display panel 120. The data driving circuit 116, or called the source driving circuit, is configured to output display data voltages to the data lines (e.g., DL1-DL6) on the display panel 120. The display data may be provided from the host device 100. More specifically, the timing control circuit 112 may receive the source display data from the host device 100 and store the display data in the register 118, which may be realized with a latch circuit. The register 118 may be integrated with or independent to the timing control circuit 112. The timing control circuit 112 may perform necessary video processing on the display data, and then send the display data to the data driving circuit 116. The timing control circuit 112 then controls the data driving circuit 116 to output the data voltages corresponding to the display data with the control timing scheme determined based on the operation mode, and correspondingly controls the gate driving circuit 114 to output the gate driving signals.

The display panel 120 includes a display pixel array, where each pixel is controlled by the gate driving circuit 114 through one of the gate lines GL1-GLn and controlled by the data driving circuit 116 through one of the data lines such as DL1-DL6. The gate driving circuit 114 may sequentially turn on the gate control switches (i.e., scan switches) in the pixels, so that the data voltages from the data driving circuit 116 may be transmitted to the pixels through the data lines DL1-DL6.

As shown in FIG. 1, each of data output terminals of the data driving circuit 116 and data lines of the display panel 120 that the driver circuit 110 drives has a one-to-multiple relationship. That is, one data output terminal of the data driving circuit 116 may output data voltages to multiple data lines on the display panel 120 in a time divisional manner. That is, each data output terminal of the data driving circuit 116 is configured to output display data voltages to multiple data lines DL1-DL6 and multiple columns of pixels. Transmission of the data voltages may be controlled through a multiplexing (MUX) circuit M1 implemented in the display panel 120. In this embodiment, the MUX circuit M1 has a 1-to-6 structure, so that each data output terminal may output data voltages to 6 data lines DL1-DL6 in a time-division manner. The MUX circuit M1 includes 6 switches SW1-SW6 coupled to the data lines DL1-DL6, respectively. The switches SW1-SW6 are well controlled to allow the data driving circuit 116 to time-divisionally output the data voltages to the pixels in the display panel 120. In an embodiment, the timing control circuit 112 may output control signals to control the operations of the switches SW1-SW6, and correspondingly control the data driving circuit 116 to perform data output, as shown in FIG. 1.

Please note that the implementation of the MUX circuit M1 as shown in FIG. 1 is merely one of various embodiments of the present invention. In another embodiment, the MUX circuit M1 may include different quantities of switches, and thus a data output terminal of the data driving circuit 116 may output data voltages to 8, 10, or any number of data lines. In addition, FIG. 1 only shows partial pixels in the display panel 120. In fact, the pixel array of the display panel 120 may include hundreds or thousands rows and hundreds or thousands columns of display pixels, and there may be multiple MUX circuits having structures identical to the MUX circuit M1 deployed in the display panel 120.

Figure 2:
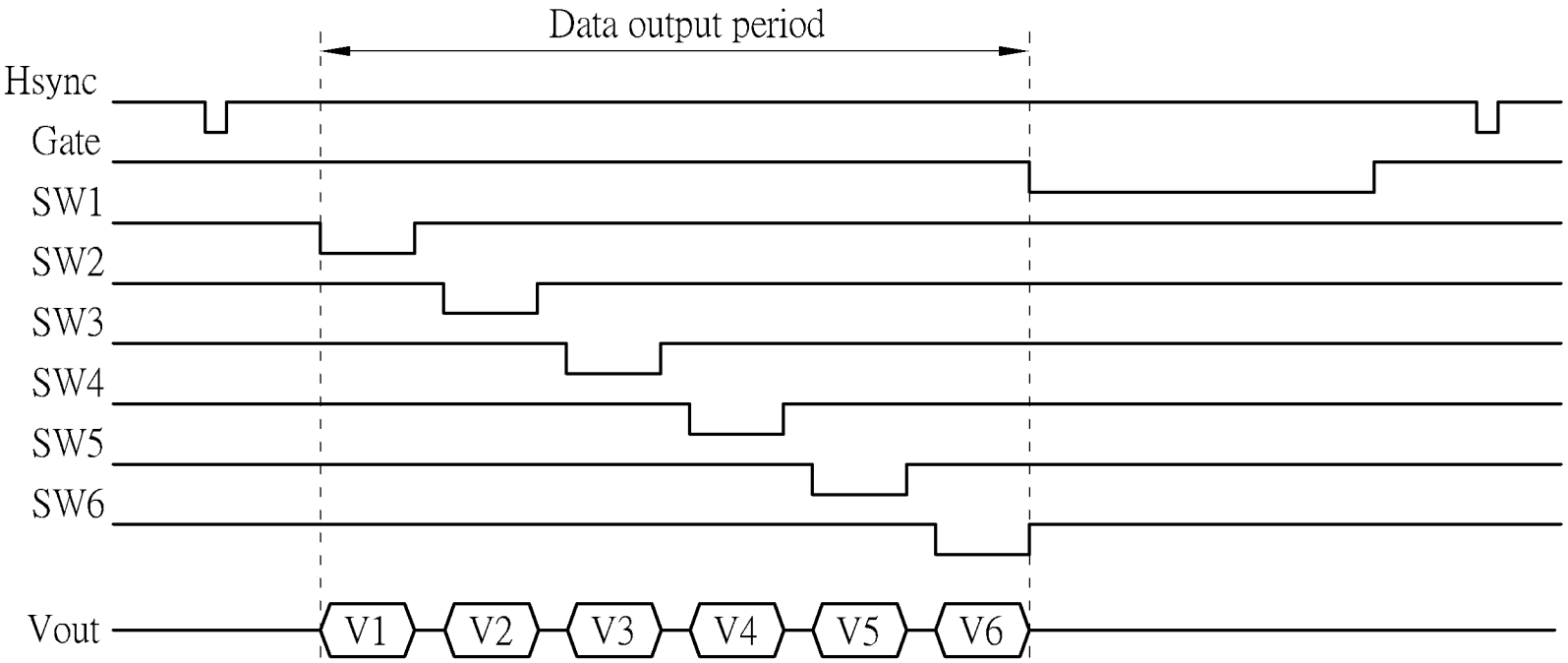
FIG. 2 is a timing diagram of the pre-charge off scheme.

The control timing schemes applicable to the display panel 120 may include a pre-charge off scheme and a pre-charge on scheme. In the pre-charge off scheme, a horizontal line period (i.e., a period during which a row of pixels (also called a horizontal line or a display line) are turned on to receive the display data voltages) includes a data output period, in which the data driving circuit 116 outputs the data voltages time-divisionally, and in the horizontal line period there is no pre-charge period included. Please refer to FIG. 2, which is a timing diagram of the pre-charge off scheme. FIG. 2 illustrates the waveforms of a horizontal synchronization signal (Hsync), the gate control signal (Gate) transmitted to a gate line to turn on/off scan switches in the pixels (or called pixel circuits) of the present horizontal line, the control signals for turning on/off the switches SW1-SW6, and the data voltages Vout output from the data driving circuit 116. As shown in FIG. 2, the signals in the low logic status or low voltage level may turn on (or connect) the target switch or transistor, and in the high logic status or high voltage level may turn off (or disconnect) the target switch or transistor.

Referring to FIG. 2 along with FIG. 1, the toggle of the horizontal synchronization signal Hsync indicates the start of each horizontal line period. During the data output period, the data driving circuit 116 outputs data voltages V1-V6 time-divisionally. Meanwhile, the switches SW1-SW6 of the MUX circuit M1 are turned on in sequence, allowing the data voltages V1-V6 to be forwarded to the data lines DL1-DL6, respectively. The electric charges corresponding to the data voltages V1-V6 are thereby stored in the parasitic capacitors of the data lines DL1-DL6. Subsequently, after the switches SW1-SW6 are turned off, the gate control signal Gate may turn on the gate control switch (e.g., which may be implemented with a thin-film transistor (TFT)) in the pixels. In this embodiment, the driving transistor is a P-type transistor which is turned on with a low voltage level. As a result, the data voltages V1-V6 stored on the data lines DL1-DL6 may be transferred to the corresponding pixels through charge sharing.

Figure 3:
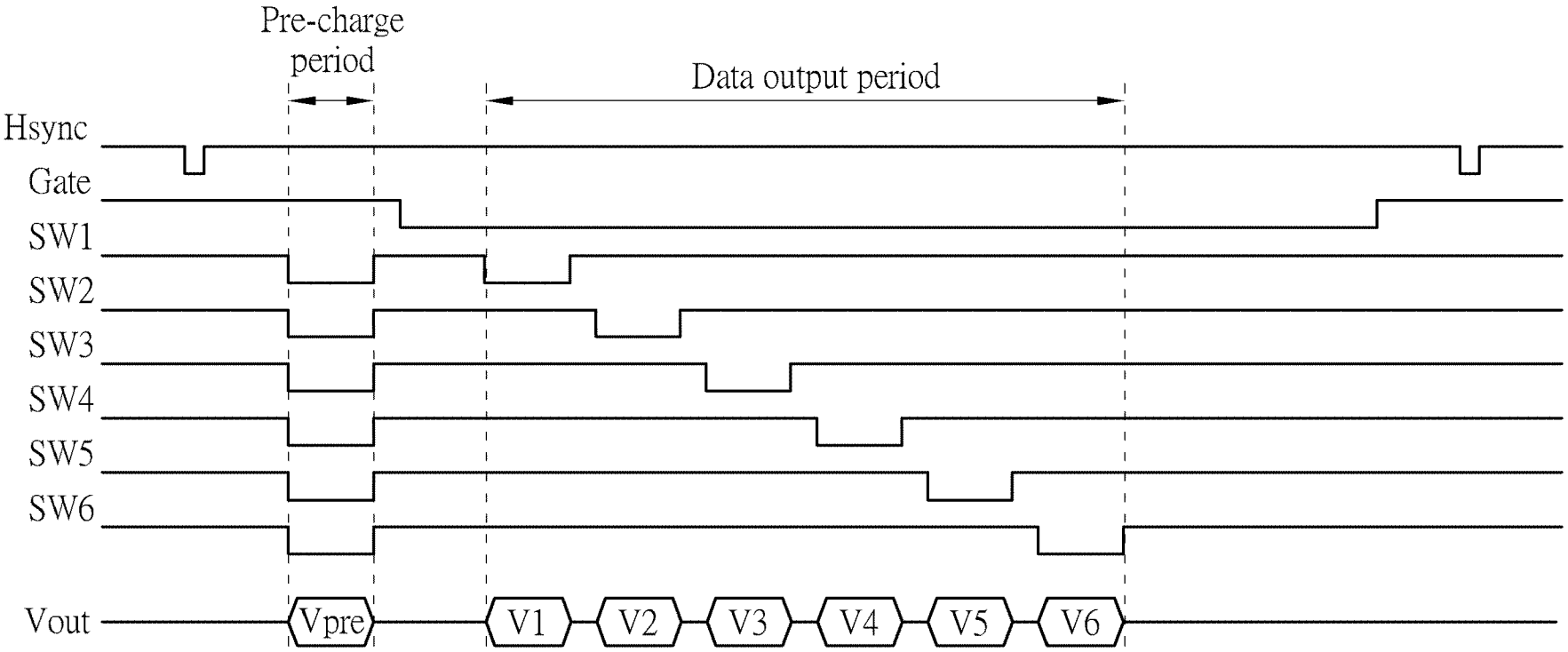
FIG. 3 is a timing diagram of the pre-charge on scheme.

Please refer to FIG. 3, which is a timing diagram of the pre-charge on scheme. As shown in FIG. 3, scan switches of the pixels of the horizontal line are simultaneously turned on by the gate control signal Gate and the scan switches of the pixels keep in turn-on state during the entire data output period where the data driving circuit 116 outputs the data voltages V1-V6 time-divisionally. Therefore, the data voltages V1-V6 may be directly input to the corresponding pixels instead of being temporarily stored in the parasitic capacitors of the data lines DL1-DL6. However, as mentioned above, when the gate control switch in a pixel is turned on but the corresponding switch in the MUX circuit M1 is not yet turned on, the residual charges (corresponding to the previous data voltage) on the corresponding data line will be input to the pixel first, such that the voltage in the pixel may reach a higher voltage level. In such a situation, due to the diode-connected structure in the pixel, the present data voltage cannot be input to the pixel if its voltage level is lower than the voltage in the pixel.

Therefore, the pre-charge on scheme further includes a pre-charge period prior to the data output period. More specifically, within the horizontal line period indicated by the horizontal synchronization signal Hsync, a pre-charge period is allocated before the data output period. In the pre-charge period, the switches SW1-SW6 of the MUX circuit M1 are in an on-status simultaneously, and the data driving circuit 116 applies a pre-charge voltage Vpre to each of the data lines DL1-DL6, to clear the residual charges on the data lines DL1-DL6. In a preferable embodiment, the switches SW1-SW6 may receive the same control signal to be turned on and turned off simultaneously in the pre-charge period. The control signal may be received from the timing control circuit 112, as shown in FIG. 1.

Figure 4:
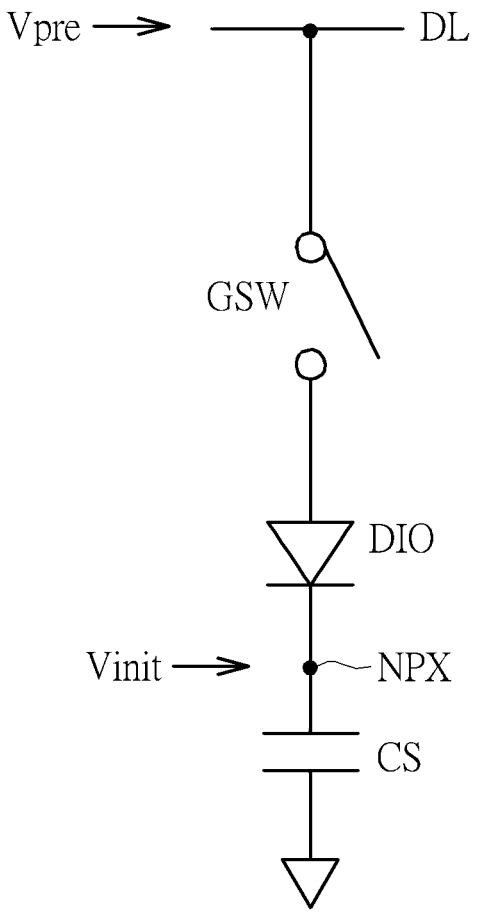
FIGS. 4 and 5 are schematic diagrams of an equivalent circuit model of a display pixel.

Please refer to FIG. 4, which is a schematic diagram of an equivalent circuit model of a display pixel. The equivalent circuit model represents the pixel in the data writing phase, where an LED pixel with a P-type driving transistor is taken as an example. As shown in FIG. 4, the equivalent circuit of the pixel includes a storage capacitor CS, a diode DIO and a gate control switch GSW. The pixel is connected to a data line DL for receiving the display data voltage, where the data line DL may be any of the data lines DL1-DL6 on the display panel 120 as shown in FIG. 1. The gate control switch GSW is used to turn on or turn off the pixel by receiving the gate control signal Gate from the gate driving circuit 114. The diode DIO refers to the diode-connected structure composed of the driving transistor and the compensation transistor of the pixel. The storage capacitor CS is configured to store the electric charges corresponding to the data voltage, which is used to drive the driving transistor in the pixel to output currents to the LED to emit light.

Referring to FIG. 4 along with the waveform shown in FIG. 3, when the previous data voltage is completely transmitted, the voltages of the data line DL and the node NPX in the pixel may both reach the previous data voltage. Subsequently, before the present data voltage is output, the electric charges stored in the storage capacitor CS need to be cleared in the initial phase. For example, the voltage level of the node NPX may be controlled to drop to a lower voltage such as the zero voltage through an initial signal Vinit. After the initial phase ends and the data writing phase starts, the gate control signal Gate turns on the gate control switch GSW before the switches SW1-SW6 of the MUX circuit M1 are turned on (as shown in FIG. 3). With the turned-on gate control switch GSW, the residual charges on the data line DL and the node NPX will perform charge sharing to reach the same voltage level. Since the capacitance value of the parasitic capacitor of the data line DL is usually much greater than the capacitance value of the storage capacitor CS in the pixel (because the length of the data line DL should span a whole column of pixels), the node NPX will reach a voltage level close to the level of the data line DL after charge sharing. If there is no pre-charge operation before the driving transistor is turned on, the voltage of the node NPX will increase during charge sharing if the previous display data voltage has a higher value, causing that the next lower display data voltage fails to pass through the diode-connected circuit to be input to the pixel.

Therefore, it is necessary to allocate a pre-charge period and apply a pre-charge voltage to avoid the above situation. As shown in FIG. 3, in the pre-charge period before the gate control signal Gate turns on the pixel, the switches SW1-SW6 are turned on simultaneously and the data driving circuit 116 outputs the pre-charge voltage Vpre to the data lines DL1-DL6, allowing the voltage level of the data lines DL1-DL6 to reach the pre-charge voltage Vpre. The pre-charge voltage Vpre may have a lower enough value that allows the subsequent data voltages V1-V6 output in the following data output period to be successfully written into the pixels. More specifically, the pre-charge voltage Vpre may have any appropriate voltage value lower than the minimum of the data voltages V1-V6 with a margin equal to or greater than the threshold voltage of the driving transistor in the diode-connected circuit.

Figure 5:
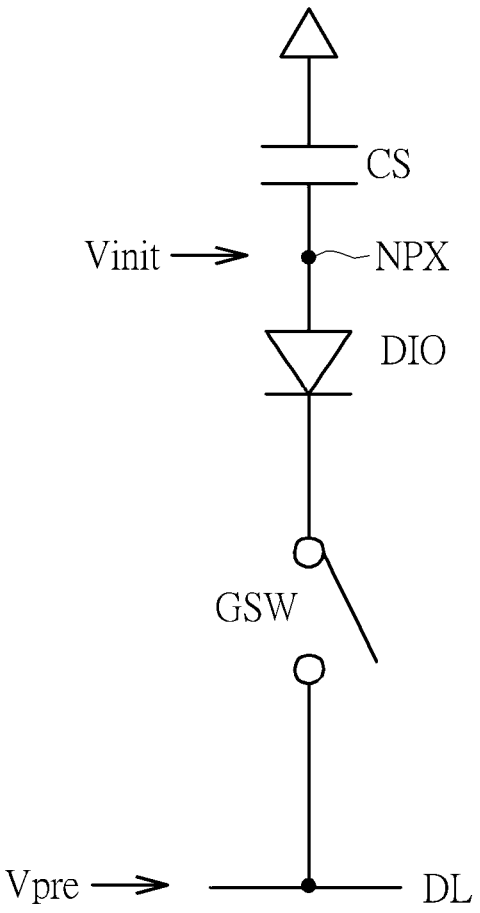

The pre-charge operation is generally applied to an OLED display panel. FIG. 4 illustrates an embodiment having a P-type driving transistor used to drive the LEDs (e.g., OLEDs), and thus the pre-charge voltage Vpre is requested to be lower than the data voltages V1-V6. In another embodiment, the control timing of the pre-charge on scheme may also be applied to the display pixel in which the LED is driven through an N-type transistor, as the equivalent circuit model shown in FIG. 5. Note that the pre-charge voltage Vpre for the N-type driven pixel should be in a higher voltage level. More specifically, the pre-charge voltage Vpre may have any appropriate voltage value higher than the maximum of the data voltages V1-V6 with a margin equal to or greater than the threshold voltage of the driving transistor. The higher pre-charge voltage Vpre will push the data line DL to a higher level in the pre-charge period, to keep the node NPX at a higher level after charge sharing, so as to avoid that the diode-connected structure of the pixel fails to be turned on by the subsequent data voltages V1-V6.

Figure 6:
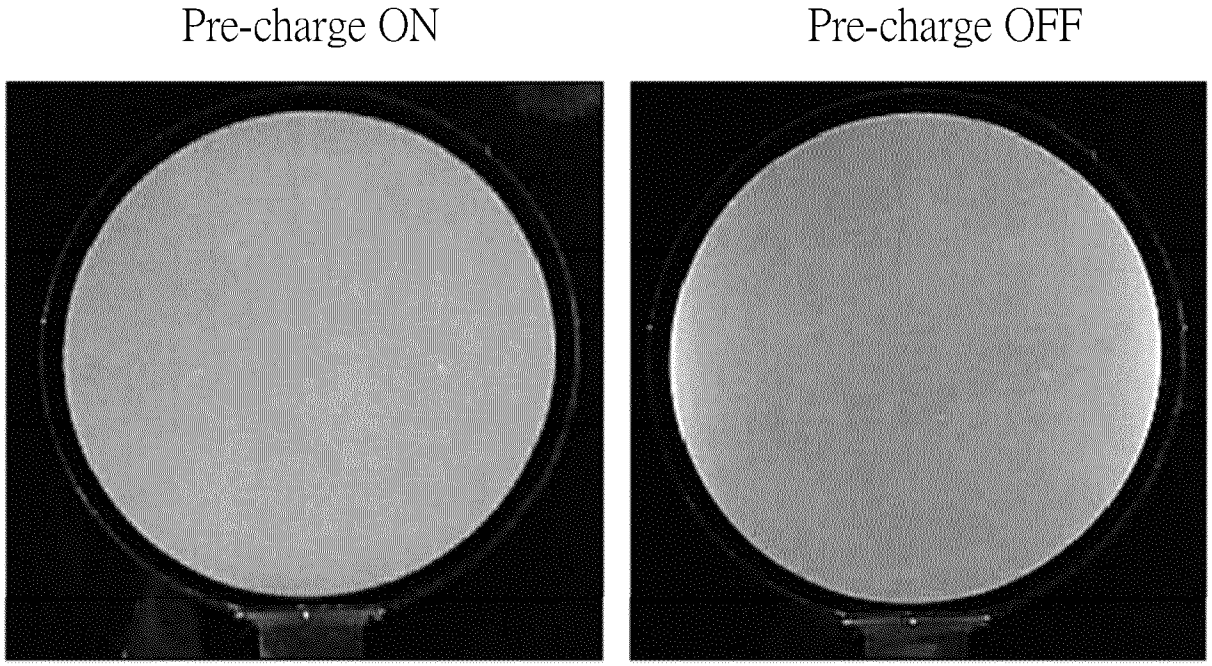
FIG. 6 is a schematic diagram of the display panel of a smart watch with the pre-charge on scheme and the pre-charge off scheme.

FIG. 2 and FIG. 3 illustrate the control timing of the pre-charge off scheme and the pre-charge on scheme, respectively. Their main difference is that, in the pre-charge off scheme, the switches SW1-SW6 of the MUX circuit M1 are turned off when the gate control switch GSW is turned on, so the pixels are charged through the electric charges on the data lines DL1-DL6, and the light emission is determined based on the quantities of electric charges sent to the pixels. In the pre-charge on scheme, the switches SW1-SW6 of the MUX circuit M1 and the gate control switch GSW are in the on-status at the same time, so the data voltages V1-V6 from the data driving circuit 116 may directly charge the pixels, and the residual charges on the data lines DL1-DL6 are cleared or reset through the pre-charge voltage Vpre in the pre-charge period prior to the charging operation of the data voltages V1-V6. Since the pre-charge on scheme additionally includes the pre-charge operation, considerable increase of the power consumption is inevitable. On the other hand, although the pre-charge off scheme may have lower power consumption, the electric charges corresponding to the data voltages V1-V6 are first stored in the data lines DL1-DL6 and then used to charge the pixels through the data lines DL1-DL6, causing the display image susceptible to the mismatch of the parasitic capacitors on the data lines DL1-DL6, which results in a decrease in visual effects. The display panel of a smart watch shown in FIG. 6 is taken as an example. It can be clearly seen that the usage of control timing of the pre-charge off scheme may cause the display area to show relatively higher brightness at both sides. This is because the lengths of the data lines at both sides of the display panel are shorter, and their parasitic capacitance is smaller than the parasitic capacitance of the data lines in the middle of the display area. Therefore, there is an evident brightness difference between the middle area and the two-sided area of the display panel when the electric charges are shared to the pixels.

As mentioned above, the pre-charge on scheme and the pre-charge off scheme have their own advantages and disadvantages. In a general display system, if the driving method of the pre-charge off scheme is used, it cannot be switched to the pre-charge on scheme, and thus the problem of poor visual effects may always exist; if the driving method of the pre-charge on scheme is used, it cannot be switched to the pre-charge off scheme, and the power consumption will always be larger. In order to obtain the advantages of these two control timing schemes, the present invention provides a hybrid control timing scheme that allows the electronic device to selectively adopt the control timing of the pre-charge on scheme or the pre-charge off scheme to control the display panel in different operation modes. In an embodiment, when the display panel is in an operation mode where the visual effects are less critical, the pre-charge off scheme may be applied to save power consumption; when the display panel is in an operation mode where the visual effects are more critical, the pre-charge on scheme may be applied to improve the visual effects.

Figure 7:
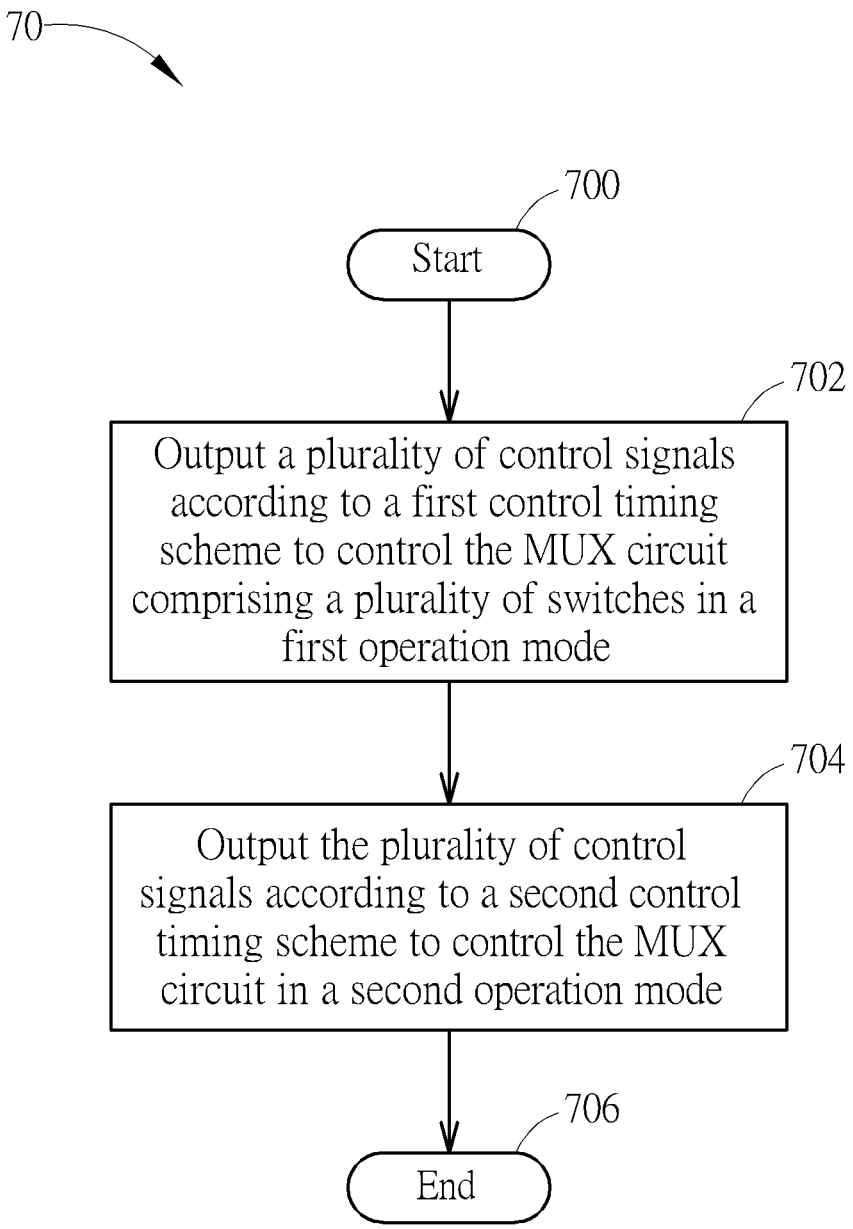
FIG. 7 is a flowchart of a control process according to an embodiment of the present invention.

Please refer to FIG. 7, which is a flowchart of a control process 70 according to an embodiment of the present invention. The control process 70 may be used in a driver circuit of a display system such as the driver circuit 110 shown in FIG. 1, for driving a display panel 120 having a MUX circuit M1 configured to couple one data output terminal of the data driving circuit 116 to multiple data lines DL1-DL6 of the display panel 120. As shown in FIG. 7, the control process 70 includes the following steps:

Step 700: Start.

Step 702: Output a plurality of control signals according to a first control timing scheme to control the MUX circuit M1 comprising the switches SW1-SW6 in a first operation mode.

Step 704: Output the plurality of control signals according to a second control timing scheme to control the MUX circuit M1 in a second operation mode.

Step 706: End.

Figure 8:
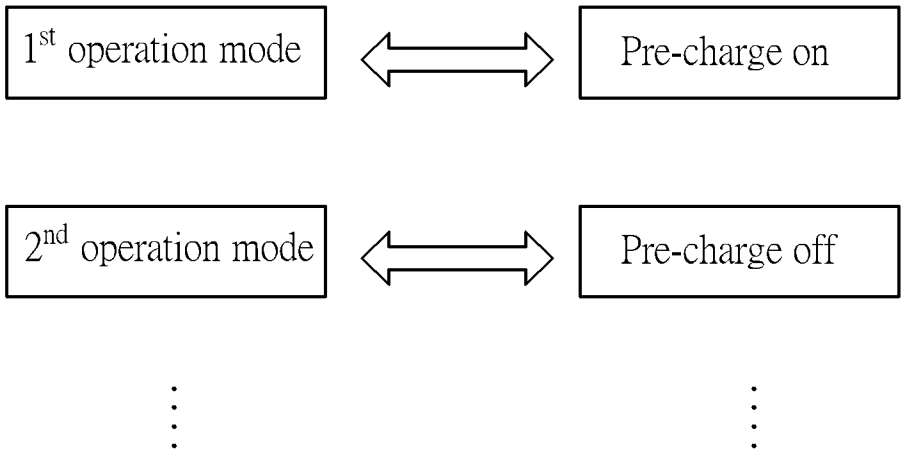
FIG. 8 illustrates the relationship of the control timing schemes and the operation modes.

According to the control process 70, the first control timing scheme may be used to control the MUX circuit M1 in the first operation mode, and the second control timing scheme may be used to control the MUX circuit M1 in the second operation mode. In an embodiment, the first control timing scheme may be the pre-charge on scheme, which includes a pre-charge period in which all switches SW1-SW6 of the MUX circuit M1 are turned on. The second control timing scheme may be the pre-charge off scheme, where no pre-charge period is included. The relationship of the control timing schemes and the operation modes is illustrated in FIG. 8.

In an embodiment, the first operation mode may be a normal display mode and the second operation mode may be an always-on-display (AOD) mode. Preferably, the pre-charge on scheme may be applied to the normal display mode and the pre-charge off scheme may be applied to the AOD mode.

In detail, since the visual effects are usually more critical in the normal display mode, the driver circuit 110 may apply the control timing of the pre-charge on scheme to drive the display panel 120 in the normal display mode, in order to achieve better visual effects. In the AOD mode, since the power consumption issue is usually more critical, the control timing of the pre-charge off scheme may be applied to drive the display panel 120, in order to save power consumption. The AOD mode is a display mode in which the electronic device only shows necessary information such as date, time and power on the display panel 120, and thus the power consumption of the driver circuit 110 in the AOD mode is usually less than the power consumption of the driver circuit 110 in the normal display mode. In the AOD mode, there is no need for good visual effects, and it is fine to use the control timing of the pre-charge off scheme to improve the power consumption with the tradeoff of worse visual effects. For example, as for a wearable device such as the smart watch, power saving and standby time extension are important considerations; hence, the wearable device is configured to be in the AOD mode most of the time, and may enter the normal display mode only when the user performs operations. Therefore, in the AOD mode, the control timing of the pre-charge off scheme may be applied to achieve a satisfactory power saving effect, and switched to the pre-charge on scheme in the normal display mode to improve the visual effects when the user is operating.

In the driver circuit 110, the timing control circuit 112 may obtain the operation mode information from the host device 100, and correspondingly determine the control timing and thereby output the control signals to the MUX circuit M1 in the display panel 120. For example, in the AOD mode, the driver circuit 110 may output the control signals and data voltages to the display panel 120 based on the control timing of the pre-charge off scheme. When the host device 100 detects a specific operation (e.g., a user interface receives an input command or a sensor detects a specific action that may be raising of the user's wrist detected by the smart watch), it may enter the normal display mode and send a mode switching command to the timing control circuit 112 of the driver circuit 110. In response, the timing control circuit 112 may be switched to apply the control timing of the pre-charge on scheme to output the control signals to the MUX circuit M1 output a command to instruct the data driving circuit 116 to output the pre-charge voltage Vpre and the data voltages V1-V6 in accordance with the control timing of the pre-charge on scheme, and also output a command to instruct the gate driving circuit 114 to perform gate line driving control correspondingly.

In the above embodiment, the normal display mode and the AOD mode are taken as an example for illustrating the relations of the operation modes and the control timing schemes. In another embodiment, the first operation mode may be a high power operation mode other than the normal display mode. Alternatively or additionally, the second operation mode may be a low power operation mode other than the AOD mode. In such a situation, the pre-charge on scheme may be applied to any high power operation mode in which the driver circuit 110 has power consumption greater than the power consumption of the driver circuit 110 in the AOD mode or any other low power operation mode. The pre-charge off scheme may be applied to any low power operation mode in which the driver circuit 110 has power consumption less than the power consumption of the driver circuit 110 in the normal display mode or any other high power operation mode. In addition, if an additional operation mode such as the third operation mode is used, the driver circuit 110 may output the control signals to the display panel 120 based on the predetermined control timing scheme corresponding to this operation mode.

Figure 9:
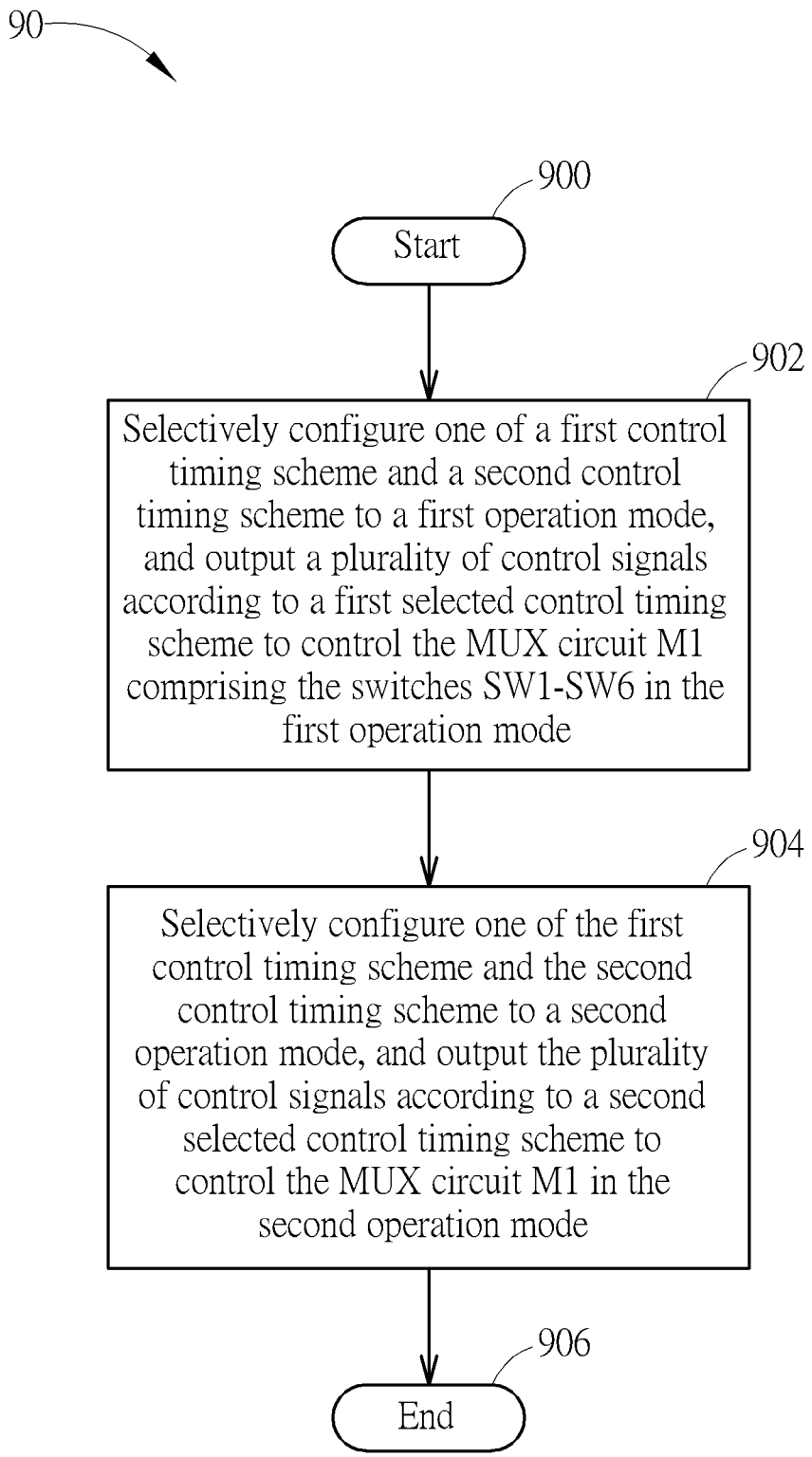
FIG. 9 is a flowchart of a control process according to an embodiment of the present invention.

Please refer to FIG. 9, which is a flowchart of a control process 90 according to an embodiment of the present invention. The control process 90 may be used in a driver circuit of a display system such as the driver circuit 110 shown in FIG. 1, for driving a display panel 120 having a MUX circuit M1 configured to couple one data output terminal of the data driving circuit 116 to multiple data lines DL1-DL6 of the display panel 120. As shown in FIG. 9, the control process 90 includes the following steps:

Step 900: Start.

Step 902: Selectively configure one of a first control timing scheme and a second control timing scheme to a first operation mode, and output a plurality of control signals according to a first selected control timing scheme to control the MUX circuit M1 comprising the switches SW1-SW6 in the first operation mode.

Step 904: Selectively configure one of the first control timing scheme and the second control timing scheme to a second operation mode, and output the plurality of control signals according to a second selected control timing scheme to control the MUX circuit M1 in the second operation mode.

Step 906: End.

Similarly, in this embodiment, the first control timing scheme may be the pre-charge on scheme, and the second control timing scheme may be the pre-charge off scheme. According to the control process 90, as for each of the first operation mode and the second operation mode, the driver circuit 110 may selectively configure one of the pre-charge on scheme and the pre-charge off scheme to the operation mode, and output the control signals to the MUX circuit M1 based on the selected control timing scheme. In this embodiment, the selected control timing scheme for the first operation mode and the selected control timing scheme for the second operation mode may be the same or different.

Figure 10:
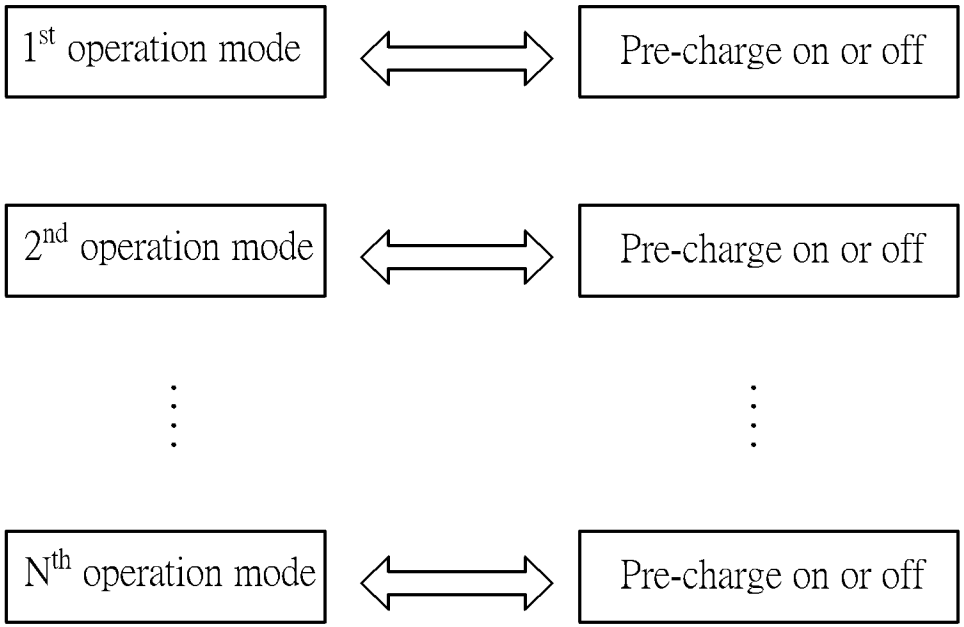
FIG. 10 illustrates the relationship of the control timing schemes and the operation modes.

Therefore, the driver circuit 110 is provided with higher flexibility to selectively apply one of the pre-charge on scheme and the pre-charge off scheme to each of the operation modes. FIG. 10 illustrates the relationship of the control timing schemes and the operation modes. Supposing that the display system 10 is configured with N operation modes where N is greater than or equal to 2, each of the N operation modes may use one of the pre-charge on scheme and the pre-charge off scheme to perform panel control. These operation modes may include the normal display mode, the AOD mode, a high dynamic range mode, a low frame rate mode, and/or any other possible operation mode applicable to the display system 10.

As a result, according to the mode command from the host device 100, the driver circuit 110 may selectively use the appropriate control timing (such as the control timing shown in FIG. 2 or FIG. 3) to drive the display panel 120 in each operation mode based on whether the operation mode corresponds to the pre-charge on scheme or the pre-charge off scheme.

Please note that the present invention aims at providing a driving method and driver circuit for a display panel where the control timing of the pre-charge on scheme and the pre-charge off scheme may be selectively used in each operation mode. Those skilled in the art may make modifications and alterations accordingly. For example, in the above embodiments, the MUX circuit M1 includes 6 switches SW1-SW6 respectively coupled to 6 data lines DL1-DL6. In other embodiments, one data output terminal of the data driving circuit 116 may be coupled to any number of data lines, and the MUX circuit and its switches may be deployed accordingly. In addition, FIG. 1 only illustrates one MUX circuit M1 in the display panel 120. In fact, there may be multiple MUX circuits implemented in a display panel, and each MUX circuit and the related switches may receive the control signals and data voltages based on the selected control timing scheme. In an embodiment, multiple MUX circuits may receive the same control signals from the driver circuit 110.

In addition, the timing diagrams shown in FIG. 2 and FIG. 3 merely illustrate the control timing in one horizontal line period as indicated by the horizontal synchronization signal. When the control timing scheme is selected, the related control timing may be performed in each horizontal line period. For example, the pre-charge operations may be performed prior to the data output period in each horizontal line period if the pre-charge on scheme is selected. In another embodiment, the pre-charge on scheme may be used in a first horizontal line period and the pre-charge off scheme may be used in a second horizontal line period if there is a mode change between these two horizontal line periods.

Furthermore, in the above embodiment as shown in FIG. 1, the control signals for controlling the switches SW1-SW6 in the MUX circuit M1 are output by the timing control circuit 112 based on the operation mode information received from the host device 100. In another embodiment, the data driving circuit 116 may be configured to output the data voltages V1-V6 to the data lines DL1-DL6 and correspondingly output the control signals for the switches SW1-SW6 based on the control of the timing control circuit 112. In the driver circuit 110, the timing control circuit 112 may be integrated with the data driving circuit 116 in the same DDIC, or they may be implemented in two separate ICs. The gate driving circuit 114 may include a gate driving control circuit integrated with the data driving circuit 116 in the same DDIC and a gate-on-array (GOA) circuit implemented on the substrate of the display panel 120. The gate driving control circuit may generate and output scan control clocks to the GOA circuit such that the GOA circuit outputs gate control signals corresponding to a plurality of horizontal lines of the display panel according to the scan control clocks. The MUX circuit M1 may also be implemented on the substrate of the display panel 120.

To sum up, the present invention provides a driving method and driver circuit for a display panel, where the control timing of the pre-charge on scheme and the pre-charge off scheme may be selectively applied to control the display panel. The display panel includes a MUX circuit having multiple switches for coupling one data output terminal of the data driving circuit to multiple data lines on the display panel. The pre-charge on scheme includes a pre-charge period in which the switches of the MUX circuit are turned on and a pre-charge voltage is output to the data lines through the switches, while the pre-charge off scheme includes no pre-charge period. The display system may be configured with multiple operation modes including the normal display mode, the AOD mode . . . etc., and one of the pre-charge on scheme and the pre-charge off scheme may be applied in each operation mode. For example, in an operation mode such as the normal display mode where the visual effects are more critical, the pre-charge on scheme may be applied; in an operation mode such as the AOD mode where the power consumption is more critical, the pre-charge off scheme may be applied. Based on the selected control timing scheme, the driver circuit may output control signals and data voltages to the display panel with the predetermined timing. In this way, an optimal balance between power consumption and display quality of the display panel may be achieved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for a driver circuit, the driver circuit being configured to drive a display panel, the method comprising:

outputting a plurality of control signals according to a first control timing scheme to control a multiplexing circuit comprising a plurality of switches disposed in the display panel in a first operation mode; and outputting the plurality of control signals according to a second control timing scheme to control the multiplexing circuit in a second operation mode;

wherein the first control timing scheme comprises a pre-charge period in which the plurality of switches of the multiplexing circuit are turned on, and the second control timing scheme comprises no pre-charge period.

2. The method of claim 1, wherein the first control timing scheme and the second control timing scheme further comprise a data output period in which the driver circuit time-divisionally outputs a plurality of data voltages, and the pre-charge period is prior to the data output period in the first control timing scheme.

3. The method of claim 2, wherein in the first control timing scheme, the pre-charge period and the data output period are within a horizontal line period.

4. The method of claim 1, wherein the first operation mode is a normal display mode and power consumption of the driver circuit in the first operation mode is greater than power consumption of the driver circuit in the second operation mode.

5. The method of claim 1, wherein a pre-charge voltage is applied to a plurality of data lines of the display panel in the pre-charge period.

6. The method of claim 5, wherein the display panel is an organic light-emitting diode (organic-LED, OLED) panel having a plurality of pixels driven through P-type transistors, and the pre-charge voltage is lower than a plurality of data voltages output to the plurality of pixels in a data output period following the pre-charge period.

7. The method of claim 5, wherein the display panel is an organic light-emitting diode (organic-LED, OLED) panel having a plurality of pixels driven through N-type transistors, and the pre-charge voltage is higher than a plurality of data voltages output to the plurality of pixels in a data output period following the pre-charge period.

8. The method of claim 1, wherein the second operation mode is an always-on-display (AOD) mode and power consumption of the driver circuit in the second operation mode is less than power consumption of the driver circuit in the first operation mode.

9. The method of claim 1, wherein in the pre-charge period, all of the switches of the multiplexing circuit are in an on-status simultaneously.

10. A method for a driver circuit, the driver circuit being configured to drive a display panel, the method comprising:

selectively configuring one of a first control timing scheme and a second control timing scheme to a first operation mode;

selectively configuring one of the first control timing scheme and the second control timing scheme to a second operation mode;

outputting a plurality of control signals according to a first selected control timing scheme to control a multiplexing circuit comprising a plurality of switches disposed in the display panel in the first operation mode; and outputting the plurality of control signals according to a second selected control timing scheme to control the multiplexing circuit in the second operation mode;

wherein the first control timing scheme comprises a pre-charge period in which the plurality of switches of the multiplexing circuit are turned on, and the second control timing scheme comprises no pre-charge period.

11. The method of claim 10, wherein the first control timing scheme and the second control timing scheme further comprise a data output period in which the driver circuit time-divisionally outputs a plurality of data voltages, and the pre-charge period is prior to the data output period in the first control timing scheme.

12. The method of claim 11, wherein in the first control timing scheme, the pre-charge period and the data output period are within a horizontal line period.

13. The method of claim 10, wherein the first operation mode is a normal display mode and the second operation mode is an always-on-display (AOD) mode.

14. The method of claim 10, wherein the first operation mode is a normal display mode and power consumption of the driver circuit in the first operation mode is greater than power consumption of the driver circuit in the second operation mode.

15. The method of claim 10, wherein a pre-charge voltage is applied to a plurality of data lines of the display panel in the pre-charge period.

16. The method of claim 15, wherein the display panel is an organic light-emitting diode (organic-LED, OLED) panel having a plurality of pixels driven through P-type transistors, and the pre-charge voltage is lower than a plurality of data voltages output to the plurality of pixels in a data output period following the pre-charge period.

17. The method of claim 15, wherein the display panel is an organic light-emitting diode (organic-LED, OLED) panel having a plurality of pixels driven through N-type transistors, and the pre-charge voltage is higher than a plurality of data voltages output to the plurality of pixels in a data output period following the pre-charge period.

18. The method of claim 10, wherein in the pre-charge period, all of the switches of the multiplexing circuit are in an on-status simultaneously.

19. A driver circuit configured to drive a display panel, the driver circuit being configured to:

output a plurality of control signals according to a first control timing scheme to control a multiplexing circuit comprising a plurality of switches disposed in the display panel in a first operation mode; and output the plurality of control signals according to a second control timing scheme to control the multiplexing circuit in a second operation mode;

wherein the first control timing scheme comprises a pre-charge period in which the plurality of switches of the multiplexing circuit are turned on, and the second control timing scheme comprises no pre-charge period.

20. The driver circuit of claim 19, wherein the first control timing scheme and the second control timing scheme further comprise a data output period in which the driver circuit time-divisionally outputs a plurality of data voltages, and the pre-charge period is prior to the data output period in the first control timing scheme.

21. The driver circuit of claim 20, wherein in the first control timing scheme, the pre-charge period and the data output period are within a horizontal line period.

22. The driver circuit of claim 19, wherein the first operation mode is a normal display mode and power consumption of the driver circuit in the first operation mode is greater than power consumption of the driver circuit in the second operation mode.

23. The driver circuit of claim 19, wherein a pre-charge voltage is applied to a plurality of data lines of the display panel in the pre-charge period.

24. The driver circuit of claim 23, wherein the display panel is an organic light-emitting diode (organic-LED, OLED) panel having a plurality of pixels driven through P-type transistors, and the pre-charge voltage is lower than a plurality of data voltages output to the plurality of pixels in a data output period following the pre-charge period.

25. The driver circuit of claim 23, wherein the display panel is an organic light-emitting diode (organic-LED, OLED) panel having a plurality of pixels driven through N-type transistors, and the pre-charge voltage is higher than a plurality of data voltages output to the plurality of pixels in a data output period following the pre-charge period.

26. The driver circuit of claim 19, wherein the second operation mode is an always-on-display (AOD) mode and power consumption of the driver circuit in the second operation mode is less than power consumption of the driver circuit in the first operation mode.

27. The driver circuit of claim 19, wherein in the pre-charge period, all of the switches of the multiplexing circuit are in an on-status simultaneously.

28. A driver circuit configured to drive a display panel, the driver circuit being configured to:

selectively configure one of a first control timing scheme and a second control timing scheme to a first operation mode;

selectively configure one of the first control timing scheme and the second control timing scheme to a second operation mode;

output a plurality of control signals according to a first selected control timing scheme to control a multiplexing circuit comprising a plurality of switches disposed in the display panel in the first operation mode; and output the plurality of control signals according to a second selected control timing scheme to control the multiplexing circuit in the second operation mode;

wherein the first control timing scheme comprises a pre-charge period in which the plurality of switches of the multiplexing circuit are turned on, and the second control timing scheme comprises no pre-charge period.

29. The driver circuit of claim 28, wherein the first control timing scheme and the second control timing scheme further comprise a data output period in which the driver circuit time-divisionally outputs a plurality of data voltages, and the pre-charge period is prior to the data output period in the first control timing scheme.

30. The driver circuit of claim 29, wherein in the first control timing scheme, the pre-charge period and the data output period are within a horizontal line period.

31. The driver circuit of claim 28, wherein the first operation mode is a normal display mode and the second operation mode is an always-on-display (AOD) mode.

32. The driver circuit of claim 28, wherein the first operation mode is a normal display mode and power consumption of the driver circuit in the first operation mode is greater than power consumption of the driver circuit in the second operation mode.

33. The driver circuit of claim 28, wherein a pre-charge voltage is applied to a plurality of data lines of the display panel in the pre-charge period.

34. The driver circuit of claim 33, wherein the display panel is an organic light-emitting diode (organic-LED, OLED) panel having a plurality of pixels driven through P-type transistors, and the pre-charge voltage is lower than a plurality of data voltages output to the plurality of pixels in a data output period following the pre-charge period.

35. The driver circuit of claim 33, wherein the display panel is an organic light-emitting diode (organic-LED, OLED) panel having a plurality of pixels driven through N-type transistors, and the pre-charge voltage is higher than a plurality of data voltages output to the plurality of pixels in a data output period following the pre-charge period.

36. The driver circuit of claim 28, wherein in the pre-charge period, all of the switches of the multiplexing circuit are in an on-status simultaneously.

* * * * *